United States Patent [19]

Rajaram et al.

[11] 4,452,392

[45] Jun. 5, 1984

[54] RAIL SPRING CLIP FASTENING ASSEMBLY

[76] Inventors: Bojji Rajaram; A. R. Bhat; M. B. Chakravarty, all of Campus of Research, Designs and Standards Organisation, Ministry of Railways, Manaknagar, Lucknow, State of U.P., India

[21] Appl. No.: 318,119

[22] Filed: Nov. 4, 1981

[51] Int. Cl.[3] ..... E01B 9/10; E01B 9/30; E01B 29/24

[52] U.S. Cl. ..... 238/349; 238/352

[58] Field of Search ..... 238/349, 351, 352

[56] References Cited

U.S. PATENT DOCUMENTS

| | | | |
|---|---|---|---|
| 1,926,088 | 9/1933 | Faries et al. | 238/349 X |
| 1,998,043 | 4/1935 | Boyd et al. | 238/349 X |
| 2,205,584 | 6/1940 | Warr | 238/349 X |
| 2,257,077 | 9/1941 | Scholes | 238/349 |
| 3,658,246 | 4/1972 | Davies | 238/349 |
| 3,784,098 | 1/1974 | Serafin et al. | 238/349 |
| 3,876,141 | 4/1975 | French | 238/349 |

FOREIGN PATENT DOCUMENTS

| | | | |
|---|---|---|---|
| 683961 | 12/1952 | United Kingdom | 238/349 |
| 706056 | 3/1954 | United Kingdom | 238/352 |
| 1271186 | 4/1972 | United Kingdom | 238/349 |

*Primary Examiner*—Robert B. Reeves
*Assistant Examiner*—Howard Beltran

[57] ABSTRACT

Improved rail fastening assembly consisting of a clip and an insert or retaining member, the clip being made from a spring steel rod and comprising an elongated rail pressing toe member, each end whereof is bent upwardly to form a first curved portion, referred to as toe curve of generally inverted U shape and disposed in vertical plane, the rod being further bent downwardly to form a second curved portion of generally U shape in the same vertical plane, the ends of said second curved portions being then bent outwardly to form third curved portions being the heel curves and extending into heel legs at a tangent to the said heel curves, the insert having a fulcrumming pin for second curved portions and a pin which is constrained to be inserted between a shoulder of the insert and the heel curves.

5 Claims, 6 Drawing Figures

RAIL SPRING CLIP FASTENING ASSEMBLY

BACKGROUND OF THE INVENTION

1. Field of the Invention

This invention relates to means for resiliently fastening the railway rail to the sleeper.

2. State of the Art

Various types of resilient clips for securing the rail to the sleeper are already known and in all such constructions, the clip when fixed in position is intended to apply downward pressure on the foot of the rail, through a toe or bearing member which rests on the rail foot, and the clip includes another member which when in torsion causes the said toe member to apply downward pressure on the rail foot by taking reaction against a fixed element which is an insert also referred to as a retaining member and which is fitted to the sleeper. Each construction however has its own characteristic features in order to achieve the aforesaid objective and this will be found from some prior art constructions reference to which is given herein.

One type of resilient clip is disclosed in British Pat. No. 683,961 of 1950 which shows a construction in which the clip comprises a pair of two L-section brackets whose horizontal arms are oppositely directed to each other and rest on the sleeper. The brackets have vertical arms having openings for the passage of an actuating pin which in turn is capable of applying pressure on the clip whereby pressure is applied on the foot of the rail. The clip is made of laminated construction.

Another type of resilient clip is disclosed in British Pat. No. 706,056 of 1951. The clamp according to this Patent is in the form of a closed ring having a portion extending across the bottom flange of the rail. This portion forms one S-end of the clamp if seen in the longitudinal direction of the rail. A portion of the said clamp is then bent downwardly towards the bottom rail flange of the rail to touch the top of the said rail flange.

The clamp has opposed side portions which extend downwardly in curved form along the opposed longitudinal side faces of the sleeper and then turn back upwardly to join a portion resting on the upper face of the said sleeper. This turned back portion forms the other S-end of the clamp when viewed in the longitudinal direction of the rail. The side portions of the clamp extend at the longitudinal side faces of the sleeper beneath a pin which is inserted into a tube founded in the sleeper and projecting therethrough approximately horizontally. The clamp is, therefore, forced to slip below the projecting portion of the pin extending from the sleeper. When mounting the securing device, a vertically downwardly directed force has to be applied on the clamp for resiliently moving it down beneath the apertures of the tube so that the pin can be inserted into the tube to a position for engagement with the two portions of the clamp ring which extend along the longitudinal side faces of the sleeper to retain the clamp under spring tension. The bearing member for the sleeper consists of one or two curved portions.

There is also known another type of resilient clip called the Pandrol (Trademark) clip which is made out of a length of resilient metal of rod form which is bent so as to have, progressing from one end of the length of metal to the other, a first portion which constitutes a substantially straight leg, then a second portion in the form of a reverse bend, then a third portion extending generally in the direction of said one end, then a fourth portion which extends from the third portion, generally to that side thereof upon which said leg is disposed and constitutes a second reverse bend, and finally a fifth portion extending in the general direction towards the junction between the first and second portions, the configuration being such that when the fastening member is fitted in position, with its first portion horizontal and it is viewed in plan, the third and fifth portions appear to be on opposite sides of said first portion.

OBJECT OF THE INVENTION

In the known types of resilient clips, either the shape of the clip is complex in nature or the retaining member also referred to as insert for the clip has to be so designed as to be suitable for the particular type of clip. Moreover it has been found that all the existing clips are made from spring steel bar material having a diameter of about ¾" to 1" which results in high cost of manufacture.

It is the object of the present invention to have a resilient clip which can be manufactured from spring steel rod of a thinner section than the rods used in the manufacture of existing clips. It is further the object of this invention that for a given performance of clip the maximum stressing of any part of the clip should be less than in the case of the existing clips and that a greater working deflection of the clip be obtained for the same maximum stess than what is obtained with the clips so far proposed and finally the weight should be substantially reduced.

SUMMARY OF THE INVENTION

In order to achieve the above object according to this invention, the rail fastening assembly comprises a resilient clip made out of spring steel rod and a retaining member or insert, said clip comprising an elongate rail pressing toe member to bear upon the foot of the rail, each end of said member being bent upwardly to form a first curved portion or toe curve of generally inverted U-shape and disposed in vertical plane, then bent downwardly to form a second curved portion of generally U-shape in the same vertical plane, the end of said second curved portion being then bent outwardly away from the toe member to form in termination a third curved member being a heel curve extending into a heel leg at a tangent to said heel curve, said clip being adapted for use with an insert fixed to the sleeper ajacent the rail foot on the side thereof, said insert comprising fulcrumming means and constraining means respectively provided therewith so that after the heel legs are forcibly flexed upwards by the said constraining means to retain the said legs of the clip in raised position, the said second curved portion comes into firm engagement with the fulcrumming means of the insert whereby the first curved portion is flexed to cause the elongate toe member to apply pressure on the rail foot, said pressure being maintained with the constraining member in position.

The rail supporting means referred to as sleeper may be a concrete sleeper, or a wooden sleeper or any other known type of supporting means.

DESCRIPTION WITH RESPECT TO THE DRAWINGS

The invention will now be more fully described with reference to the accompanying drawings in which.

Figure 1:
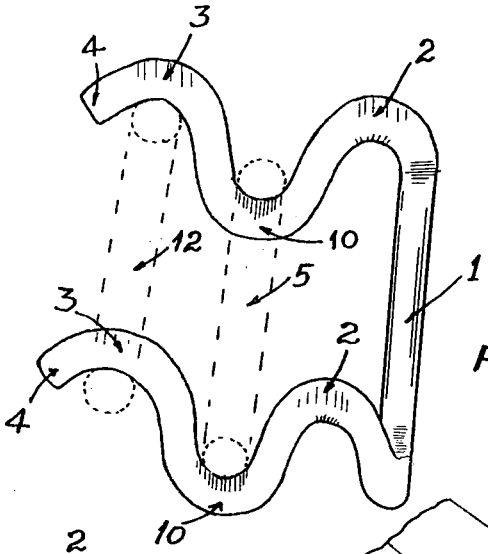
FIG. 1 shows the clip in its perspective view.
Figure 2:
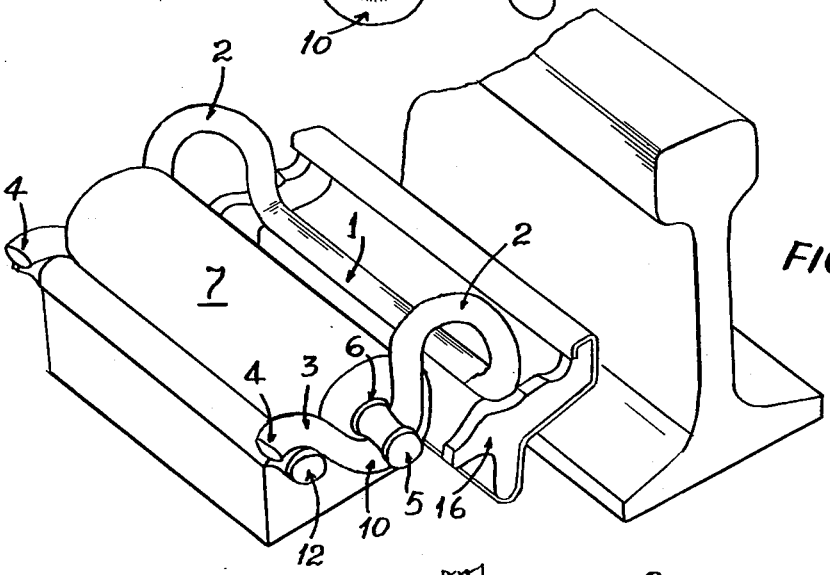
FIG. 2 shows the clip in use along with the insert; (not shown as fixed to the rail supporting means).
Figure 3:
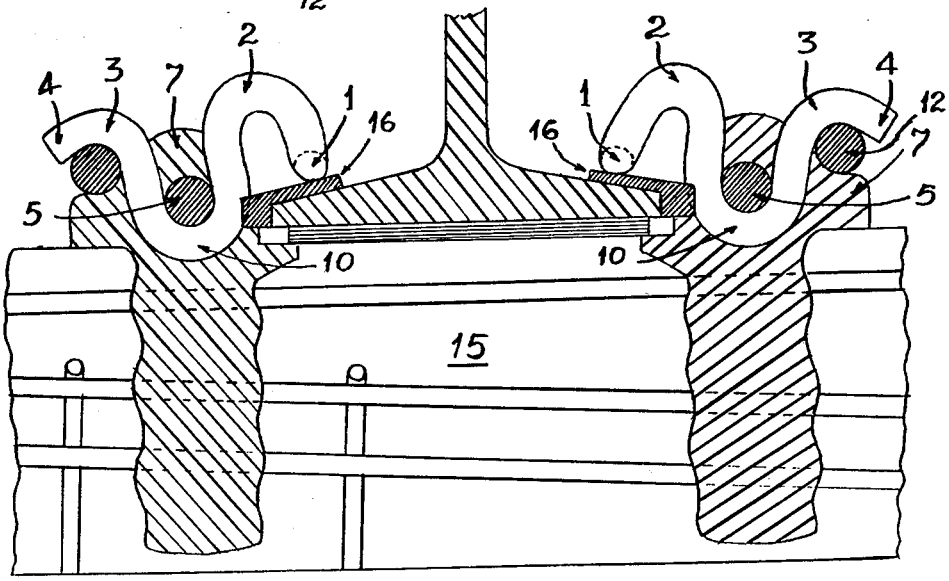
FIG. 3 shows end view of the clip and insert or retaining member in use with a concrete sleeper.

Referring to the drawings, in FIGS. 1, 2 and 3 is shown the clip made of spring steel rod having a toe member 1 which preferably has a flat surface at its face which is in contact with the rail or with a liner 16 when used. The toe member 1 is bent at its two opposite ends to first form toe curves 2 of substantially inverted U shape in a plane generally perpendicular to the toe member 1. The rod is then bent downwardly to form generally U shaped second curves which constitute the central loops or curves 10. The rod is then bent upwardly to form in termination short heel curves 3 being the third curves and then extended as shown at 4 at a tangent to the curves 3 to form legs 4. Thus similar shapes are developed at both ends of the toe member 1.

As shown in FIG. 2, the clip is used with an insert 7 which is fixed to the concrete sleeper 15 (FIG. 3). The insert 7 has a through bore for the passage of a fulcrumming pin 5, the ends of which are thickened after insertion to prevent the same from slipping out. The ends of the pin 5 project from the eyes 6 of the said bore in the insert as shown in FIG. 2. The toe curve 1 is seated over the bottom flange of the rail through a liner 16 if used.

In order to fit the clamp, the toe member 1 is made to rest on the rail foot. The curved portions 10 of the clip are engaged by the projecting ends of the central pin 5. The legs 4 which extend from the heel curves 3 initially rest on the shoulder of the insert 7. In order to cause the toe member 1 of the clip to apply downward pressure on the foot of the rail, the heel curves 3 are forcibly lifted upwards through the legs 4 for inserting a pin 12 which forms the constraining member between the shoulder of the insert and the heel curves 3. In this state the central pin 5 functions as a fulcrumming member for the second curved portions or loops 10 of the clip, resulting in the application of pressure of the elongate toe member 1 on the rail foot. The pressure continues to be applied so long as the pin 12 is held below the heel curves 3.

In FIG. 3 is shown an arrangement in which the insert is embedded in the concrete sleeper 15.

Figure 4:
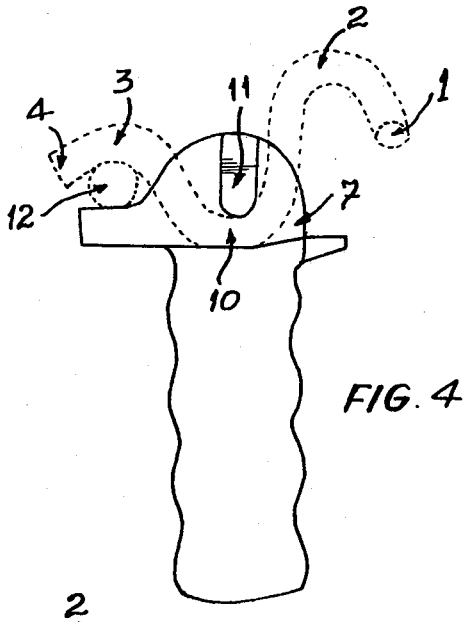
FIG. 4 shows an alternative form of insert in which projections are formed to function as fulcrumming means.

FIG. 4 shows an alternative form of insert 7 whose stem can be embedded in the concrete sleeper in the same manner as in FIG. 3. It has projections 11 which function as fulcrumming means in place of the pin 5 of the construction shown in FIGS. 2 and 3. The insert of FIG. 4, has, therefore, no central bore but is a solid piece with projections 11 at either ends.

Figure 5:
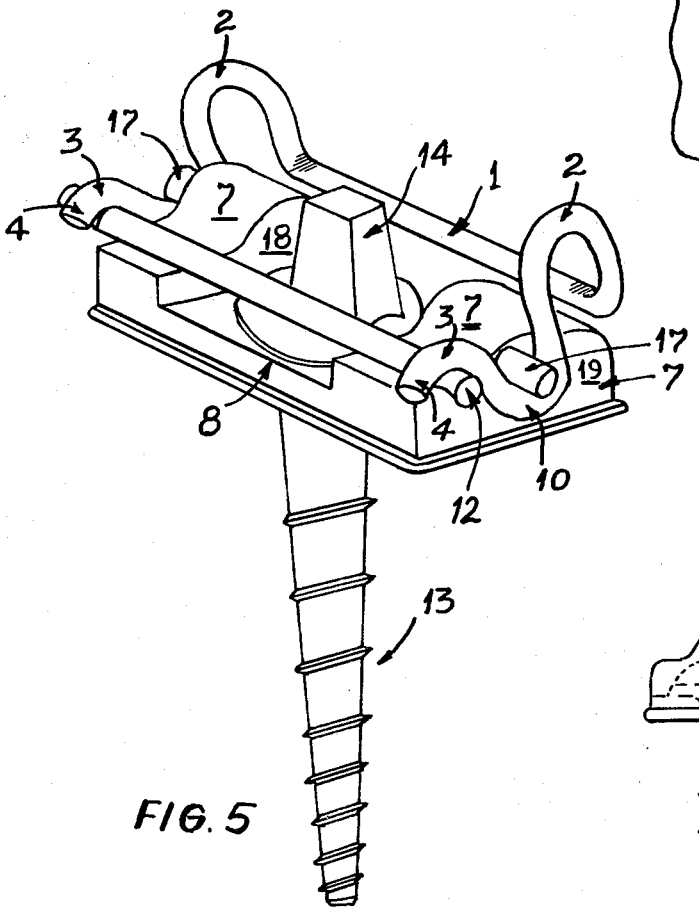
FIGS. 5 and 6 show perspective and side views respectively of the clip when used with wooden sleepers.
Figure 6:
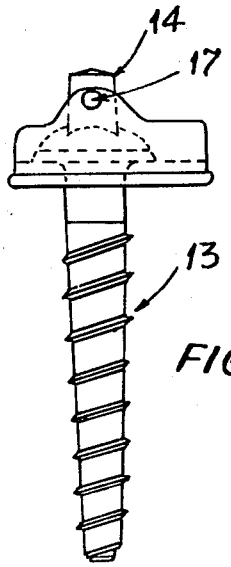

Referring to FIGS. 5 and 6 which relate to the use of the clip and the insert in the case of wooden sleepers, the insert is substantially of U shape and has an opening 8 in its base between the vertical members 19 and 18, for the insertion of the screw spike 13. The head 14 of the spike is seated on the base of the insert. Further, the insert has two integral lugs or projections 17 for the central loop 10 of the clip to engage the same. In all other respects the construction and the functioning of the clip and the insert is the same.

In FIG. 6 are shown more clearly the lugs or projections 17 which are engaged by the central curves or loops 10 of the clip.

Initially the clip is placed with its toe member just resting on the rail foot directly or through a liner. In this position the central bend will be below the eye or bore of the insert of FIGS. 2 and 3 while the toe heels and legs will be resting on the shoulder of the insert. When a pin is to be inserted between the toe heels and the shoulder of the insert, the legs 4 are flexed up by means of any convenient tool such as a two pronged tool to an extent as to enable pin 12 to be inserted between the toe heels and the shoulder of the retaining member. This flexing of the legs will cause the toe member to apply downward pressure on the foot of the rail, the central pin 5 functioning as fulcrum and providing the requisite reaction in the central curve 10.

It has been found by experiments that by use of the clip made according to this invention, the required toe load on the rail foot can be obtained. The diameter of the section of the rod which gives the required effect can be reduced to even one half of an inch but at any rate less than $\frac{3}{4}$ inch.

I claim:

1. Rail fastening assembly comprising a resilient clip made out of spring steel rod and a retaining member including a bearing surface, said clip comprising a straight light portion for resting on the foot of a rail and functioning as a toe member, each end of the said straight portion of the rod being first bent upwardly from the toe member to define a pair of arms therewith is a first plane, then bent downwardly to define with said upwardly bent portion a second plane perpendicular to said first plane to form a first curved portion of substantially inverted U-shape, then further extended and bent upwardly in said second plane to form a second central reversed curve of substantially U-shape and yet further extended and bent downwardly in said second plane to thereby form a heel curve terminating in a heel member at each end of the arms of the clip, said retaining member carrying a first pin disposed in a plane parallel to said first plane, said central curves bearing upwardly against said first pin, said heel members defining means for bearing on said retaining member upon engagement with a heel pin inserted between the said heel members and said retaining member bearing surface, whereby after positioning said rail fastening assembly and fitting said heel pin between said heel members and said bearing surface, said heel members are lifted upwardly to thereby produce an upward thrust about said first pin, said upward thrust being converted, through the interaction of said first pin with said central curves, to a downward thrust of the toe member on the rail foot.

2. Rail fastening assembly as claimed in claim 1 in which said retaining member is provided with projections on opposing sides, said projections being held against the central curves of the clip and acting as fulcrums when said heel curves are forcibly lifted up for the insertion of said heel pin.

3. A rail fastening assembly as claimed in claim 1, and further comprising a wooden sleeper, said retaining member including a U-shaped portion having aperture means at the base of said portion for receiving a fastening member, and vertical members having horizontal projections defining means for abutting the central curves of the clip to act as fulcrumming means when the heel curves are forcibly lifted up upon insertion of the heel pin.

4. A rail fastening assembly for fixing the foot of a rail member to a sleeper, comprising:

a resilient, flexible clip having a light forming first bearing surface means for enagaging said rail member foot, a pair of arms forming second bearing surface means, and a first U-shaped portion disposed therebetween, said first and second bearing surface means being directed downwardly;

a retaining member, attachable to said sleeper adjacent said rail member foot, for engagement with said clip, said retaining member including means, projecting laterally therefrom, for engaging said clip first U-shaped portion, said retaining member further including bearing surface means, said clip second bearing surface means normally being in close proximity to said retaining member bearing surface means when said clip is engaged with said retaining member; and pin means, forcibly insertable between said retaining member bearing surface means and said clip second bearing surface means, for moving said clip second bearing surface means away from said retaining member bearing surface means, said pin means coacting with said clip second bearing surface means, said clip first portion and said retaining member engaging means to force said clip first bearing surface means into pressing engagement with said rail member foot.

5. The rail fastening assembly of claim 4 wherein said clip first portion is pivotably seatable on said retaining member engaging means, and defines, with said retaining member engaging means, means for converting the upwardly directed force applied to said clip second bearing surface means to a downwardly directed force for application by said clip first bearing surface means to said rail member foot.

* * * * *